US009708879B2

(12) United States Patent
Wood et al.

(10) Patent No.: US 9,708,879 B2
(45) Date of Patent: Jul. 18, 2017

(54) ISOLATION BARRIER

(71) Applicant: Meta Downhole Limited, Aberdeen (GB)

(72) Inventors: Peter Wood, Aberdeen (GB); Daniel O'Brien, Stonehaven (GB)

(73) Assignee: MORPHPACKERS LIMITED (GB)

( * ) Notice: Subject to any disclaimer, the term of this patent is extended or adjusted under 35 U.S.C. 154(b) by 19 days.

(21) Appl. No.: 14/769,019

(22) PCT Filed: Mar. 3, 2014

(86) PCT No.: PCT/GB2014/050607
§ 371 (c)(1),
(2) Date: Aug. 19, 2015

(87) PCT Pub. No.: WO2014/135848
PCT Pub. Date: Sep. 12, 2014

(65) Prior Publication Data

US 2016/0003000 A1 Jan. 7, 2016

(30) Foreign Application Priority Data

Mar. 4, 2013 (GB) ..... 1303810.4

(51) Int. Cl.
*E21B 23/06* (2006.01)
*E21B 33/127* (2006.01)
(Continued)

(52) U.S. Cl.
CPC ..... *E21B 33/127* (2013.01); *E21B 23/06* (2013.01); *E21B 33/1208* (2013.01);
(Continued)

(58) Field of Classification Search
CPC .. E21B 23/06; E21B 33/1208; E21B 33/1212; E21B 33/1243; E21B 33/127; E21B 34/063; E21B 34/10
See application file for complete search history.

(56) References Cited

U.S. PATENT DOCUMENTS 5,375,662 A * 12/1994 Echols, III ..... E21B 23/04 166/187
7,017,670 B2 * 3/2006 Hazel ..... E21B 29/10 166/147
(Continued)

FOREIGN PATENT DOCUMENTS

GB 2398312 A 8/2004
GB 2430214 A 3/2007
(Continued)

*Primary Examiner* — Matthew R Buck
(74) *Attorney, Agent, or Firm* — Law Office of Jesse D. Lambert, LLC

(57) ABSTRACT

An apparatus (10) and method, particularly useful for isolating zones in a hydrocarbon open hole well bore (80). The apparatus includes a tubular body (12), arranged to be run into and secured within the well bore. A sleeve member (14) is positioned on the exterior of the body and is sealed thereto creating a chamber (16) therebetween. Pressure is applied through a port (18) in the body to cause the sleeve member to move outwardly and morph to an inner wall of the well bore. Pressure is trapped in the chamber and maintained at a morphed pressure value by pressure balancing means in the form of a biased piston (64).

13 Claims, 2 Drawing Sheets

(51) Int. Cl.

| | |
|---|---|
| ***E21B 33/12*** | (2006.01) |
| ***E21B 33/124*** | (2006.01) |
| ***E21B 34/10*** | (2006.01) |
| ***E21B 34/06*** | (2006.01) |

(52) U.S. Cl.
CPC ..... *E21B 33/1212* (2013.01); *E21B 33/1243* (2013.01); *E21B 34/063* (2013.01); *E21B 34/10* (2013.01)

(56) References Cited

U.S. PATENT DOCUMENTS 7,178,603 B2 * 2/2007 Naquin, Sr. ..... E21B 33/134 166/126
7,306,033 B2 * 12/2007 Gorrara ..... E21B 33/127 166/187
7,387,157 B2 * 6/2008 Gambier ..... E21B 23/06 166/185
8,448,713 B2 * 5/2013 Munshi ..... E21B 33/127 166/179
2006/0027371 A1 2/2006 Gorrara
2006/0042801 A1 * 3/2006 Hackworth ..... E21B 29/10 166/387
2012/0125619 A1 * 5/2012 Wood ..... E21B 33/1212 166/308.1
2014/0216755 A1 * 8/2014 Hallundæk ..... E21B 23/06 166/373

FOREIGN PATENT DOCUMENTS

GB WO 2010136806 A2 * 12/2010 ..... E21B 33/1212
WO WO 00/37769 A1 6/2000
WO WO 00/63523 A1 10/2000

* cited by examiner

ISOLATION BARRIER

The present invention relates to an apparatus and method for securing a tubular within another tubular or borehole, creating a seal across an annulus in a well bore, centralising or anchoring tubing within a wellbore. In particular, though not exclusively, the invention relates to morphing a sleeve to secure it to a well bore wall and controlling pressure within the sleeve to maintain a seal between the sleeve and well bore wall to form an isolation barrier.

In the exploration and production of oil and gas wells, packers are typically used to isolate one section of a downhole annulus from another section of the downhole annulus. The annulus may be between tubular members, such as a liner, mandrel, production tubing and casing or between a tubular member, typically casing, and the wall of an open borehole. These packers are carried into the well on tubing and at the desired location, elastomeric seals are urged radially outwards or elastomeric bladders are inflated to cross the annulus and create a seal with the outer generally cylindrical structure i.e. another tubular member or the borehole wall. These elastomers have disadvantages, particularly when chemical injection techniques are used.

As a result, metal seals have been developed, where a tubular metal member is run in the well and at the desired location, an expander tool is run through the member. The expander tool typically has a forward cone with a body whose diameter is sized to the generally cylindrical structure so that the metal member is expanded to contact and seal against the cylindrical structure. These so-called expanded sleeves have an internal surface which, when expanded, is cylindrical and matches the profile of the expander tool. These sleeves work create seals between tubular members but can have problems in sealing against the irregular surface of an open borehole.

The present applicants have developed a technology where a metal sleeve is forced radially outwardly by the use of fluid pressure acting directly on the sleeve. Sufficient hydraulic fluid pressure is applied to move the sleeve radially outwards and cause the sleeve to morph itself onto the generally cylindrical structure. The sleeve undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed sleeve. During the morphing process, both the inner and outer surfaces of the sleeve will take up the shape of the surface of the wall of the cylindrical structure. This morphed isolation barrier is therefore ideally suited for creating a seal against an irregular borehole wall.

Such a morphed isolation barrier is disclosed in U.S. Pat. No. 7,306,033, which is incorporated herein by reference. An application of the morphed isolation barrier for FRAC operations is disclosed in US2012/0125619, which is incorporated herein by reference. Typically, the sleeve is mounted around a supporting tubular body, being sealed at each end of the sleeve to create a chamber between the inner surface of the sleeve and the outer surface of the body. A port is arranged through the body so that fluid can be pumped into the chamber from the throughbore of the body.

In use, the pressure of fluid in the throughbore is increased sufficiently to enter the chamber and force the sleeve radially outwardly to morph to the generally cylindrical structure. Sufficient pressure has been applied when there is no return of fluid up the annulus which verifies that a seal has been achieved. Though the sleeve has been plastically deformed and will therefore hold its new shape, if a sufficient pressure differential is created across the sleeve wall, there is a possibility that fracture or collapse can occur and the seal may be lost.

In one application, the pressure of fluid in the throughbore is maintained to keep a high pressure in the chamber. Indeed most sleeves are set by applying maximum pressure to the sleeve. Unfortunately, there is a risk that the pressure could be high enough to rupture the sleeve. Additionally, if the pressure differential acts in the opposite direction by a pressure drop in the throughbore or by an increase in fluid pressure in the annulus below the sleeve, the sleeve can be forced away from the cylindrical structure, causing loss of the seal.

To overcome this, a check valve is used in the port. This check valve is arranged to stop fluid returning to the throughbore. Application of sufficient fluid pressure will cause fluid to enter the chamber through the valve and the sleeve morphs to the cylindrical structure. When the seal is achieved, the pressure can be bled off to leave a trapped pressure within the chamber. This allows an isolation barrier to be created which does not need a constant fluid supply to maintain it in the sealed position. A known disadvantage of this system is that if the pressure increases within the chamber there is a possibility that the body or sleeve could collapse or burst. Such an increase in pressure can occur in an event which raises the temperature of the trapped fluid, such as starting production in the well. To prevent this, a pressure relief valve is provided through the body to allow fluid to pass from the chamber back into the throughbore.

However, while such a pressure relief valve releases the over-pressure once the pressure is trapped in the chamber, it cannot prevent too much pressure being applied to morph the sleeve initially, as the pressure differential between the chamber and the throughbore will be zero.

A further problem occurs in the event that the temperature decreases. A pressure drop inside the chamber can provide a sufficient pressure differential between the chamber and the annulus, to cause the movement of the sleeve relative to the cylindrical structure. This results in loss of the seal thereby allowing fluid to pass between the sleeve and the cylindrical structure.

It is therefore an object of at least one embodiment of the present invention to provide a morphed isolation barrier which obviates or mitigates one or more disadvantages of the prior art.

It is a further object of at least one embodiment of the present invention to provide a method of creating an isolation barrier in a well bore which obviates or mitigates one or more disadvantages of the prior art.

According to a first aspect of the present invention there is provided an assembly, comprising:

a tubular body arranged to be run in and secured within a larger diameter generally cylindrical structure;

a sleeve member positioned on the exterior of the tubular body and sealed thereto to create a chamber therebetween;

the tubular body including a port having a valve to permit the flow of fluid into the chamber to increase pressure within the chamber to cause the sleeve to move outwardly and morph against an inner surface of the larger diameter structure;

wherein the valve traps pressure within the chamber to provide a morphed pressure value in the chamber; and the assembly further comprises pressure balance means to maintain the morphed pressure value in the chamber by increasing and decreasing the trapped pressure.

In this way, a morphed pressure value can be selected which is known to create the ideal plastic deformation of the sleeve without rupturing and this pressure can be maintained within the sleeve to prevent loss of anchoring or a seal to the generally cylindrical structure.

The large diameter structure may be an open hole borehole, a borehole lined with a casing or liner string which may be cemented in place downhole, or may be a pipeline within which another smaller diameter tubular section requires to be secured or centralised.

The tubular body is preferably located coaxially within the sleeve and is part of a tubular string used within a wellbore, run into an open or cased oil, gas or water well. Therefore the present invention allows a casing section or liner to be centralised within a borehole or another downhole underground or above ground pipe by provision of a morphable sleeve member positioned around the casing or liner. Centralisation occurs as the sleeve will expand radially outwardly at a uniform rate with the application of pressure through the port. Additionally, the present invention can be used to isolate one section of the downhole annulus from another section of the downhole annulus and thus can also be used to isolate one or more sections of downhole annulus from the production conduit.

Preferably the valve is a one-way check valve. In this way, fluid is prevented from exiting the chamber. More preferably the valve is set to close when the pressure in the chamber reaches the morphed pressure value. Advantageously, the valve includes a ruptureable barrier device, such as a burst disk device or the like. Preferably the barrier device is set to rupture at pressures around the morphed pressure value. In this way, fluids can be pumped down the tubing string into the well without fluids entering the sleeve until it is desirous to operate the sleeve.

Preferably the pressure balance means comprises a piston arranged within a housing, the housing being fluid coupled to the chamber. The piston therefore acts on the fluid within the chamber. In this way the pressure can be increased, decreased or maintained by varying the volume of the fluid in the chamber. Preferably the piston is arranged on the tubular body at an end of the sleeve. In this way, the pressure balance means does not interfere with the morphing of the sleeve. In an embodiment the piston is annular and located around the tubular body. In an alternative embodiment, there is a plurality of pistons arranged around the body. Such an arrangement is easier to manufacture and assemble.

Preferably the piston includes release means to operate the piston when the morphed pressure value is reached. The release means may be a shear pin as is known in the art.

Preferably a first end of the piston acts on the fluid within the chamber and an opposing end includes biasing means to move the piston against the fluid. The biasing means may be a spring contained within the housing. Alternatively, the biasing means may be a biasing fluid held within the housing.

According to a second aspect of the present invention there is provided a method of setting a morphed sleeve in a well bore, comprising the steps:

(a) locating a sleeve member on the exterior of a tubular body and sealing it thereto to create a chamber therebetween;

(b) running the tubular body on a tubular member into a wellbore and positioning the sleeve member at a desired location within a larger diameter structure;

(c) pumping fluid through the tubular member and increasing the fluid pressure to provide fluid at a morphed pressure value at the sleeve member;

(d) opening a valve in the tubular body to allow fluid to enter the chamber;

(e) continuing to pump fluid at the morphed pressure value into the chamber causing the sleeve to move radially outwardly and morph against an inner surface of the larger diameter structure;

(f) closing the valve in the tubular body to trap pressure in the chamber; and (g) operating a pressure balancing means to increase and decrease the trapped fluid pressure to maintain it at the morphed pressure value.

In this way, a controlled pressure can be applied downhole at the sleeve member to set the sleeve against the larger diameter structure. This prevents rupturing of the sleeve and allows a sleeve of lower gauge i.e. thinner walled, to be used which will morph better against any irregularities on the inner surface of the larger diameter structure. Additionally, by maintaining the pressure in the chamber at a fixed pressure, the sleeve can be provided with an operating rating so that isolation and/or anchoring can be known to be maintained.

The large diameter structure may be an open hole borehole, a borehole lined with a casing or liner string which may be cemented in place downhole, or may be a pipeline within which another smaller diameter tubular section requires to be secured or centralised.

Preferably, step (g) includes the step of exposing the fluid in the chamber to a piston and varying the volume of fluid in the chamber to increase and decrease the trapped pressure to maintain it at the morphed fluid pressure value.

Preferably, the method includes the step of rupturing a disc at the valve to allow fluid to enter the chamber when the pressure reaches a desired value. This allows pumping of fluids into the well without fluid entering the sleeve member.

The method may include the steps of running in a hydraulic fluid delivery tool, creating a temporary seal above and below the port and injecting fluid from the tool into the chamber via the port. Such an arrangement allows selective operation of the sleeve member if more than one sleeve member is arranged in the well bore.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figures 3A, 3B, 3C:
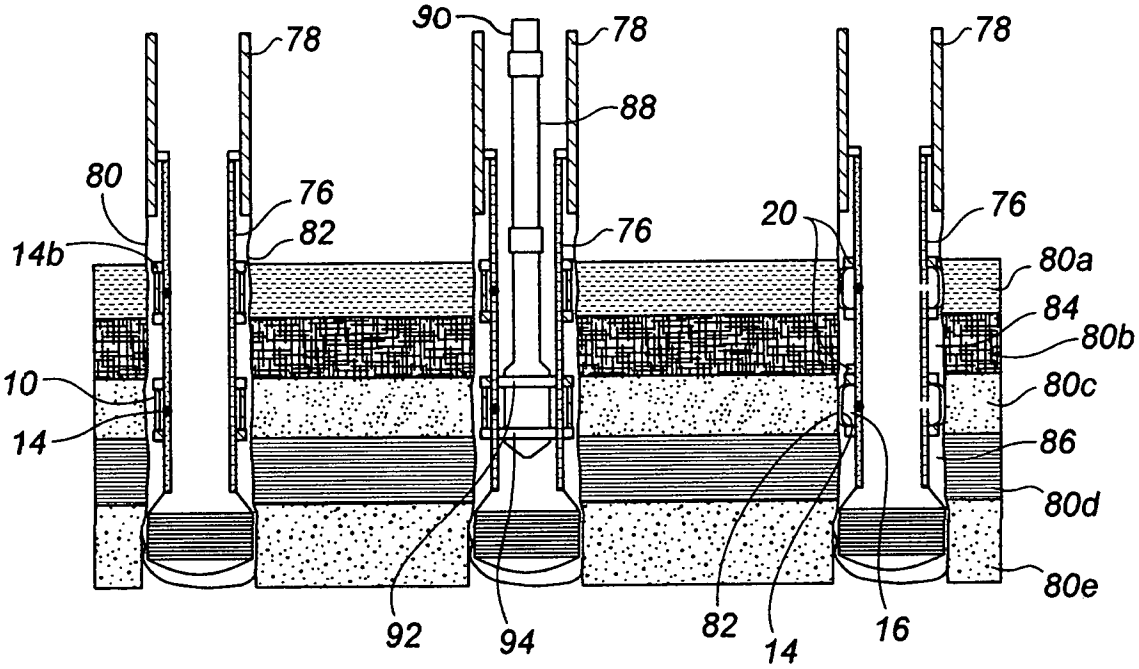
FIG. 3 is a schematic illustration of a sequence for setting two sleeve members in an open borehole.

FIG. 3*a* is a cross-sectional view of a liner provided with two sleeve members;

FIG. 3*b* shows the liner in the borehole of FIG. 3*a* with a hydraulic fluid delivery tool inserted therein; and FIG. 3*c* is a cross-sectional view of the liner of FIGS. 3*a* and 3*b* with morphed sleeves and pressure balanced chambers, in use.

Figure 1:
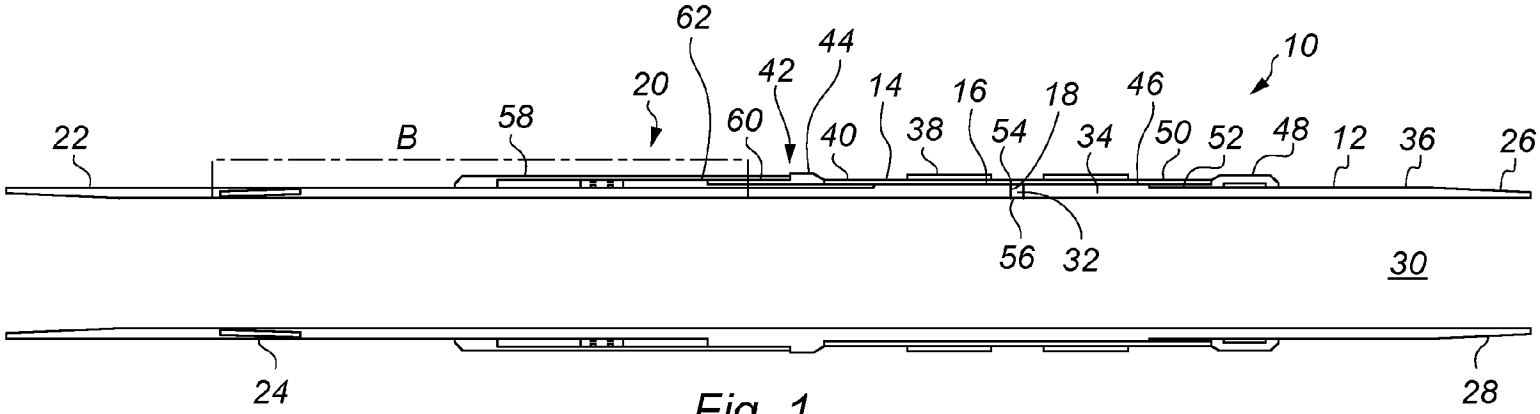
FIG. 1 is a cross-sectional view through an assembly according to an embodiment of the present invention.

Reference is initially made to FIG. 1 of the drawings which illustrates an assembly, generally indicated by reference numeral 10, including a tubular body 12, sleeve member 14, chamber 16, valve 18 and pressure balancing means, generally indicated by reference numeral 20, according to an embodiment of the present invention.

Tubular body 12 is a cylindrical tubular section having at a first end 22, a first connector 24 and at an opposite end 26, a second connector 28 for connecting the body 12 into a tubing string such as casing, liner or production tubing that is intended to be permanently set or completed in a well bore. Body 12 includes a throughbore 30 which is co-linear with the throughbore of the string.

A port 32 is provided through the side wall 34 of the body 12 to provide a fluid passageway between the throughbore 30 and the outer surface 36 of the body 12. While only a single port 32 is shown, it will be appreciated that a set of ports may be provided. These ports may be equidistantly spaced around the circumference of the body 12 and/or be arranged along the body between the first end 22 and the second end 26.

Tubular body 12 is located coaxially within a sleeve member 14. Sleeve member 14 is a steel cylinder being formed from typically 316L or Alloy 28 grade steel but could be any other suitable grade of steel or any other metal material or any other suitable material which undergoes elastic and plastic deformation. Ideally the material exhibits high ductility i.e. high strain before failure. The sleeve member 14 is appreciably thin-walled of lower gauge than the tubing body 12 and is preferably formed from a softer and/or more ductile material than that used for the tool body 12. The sleeve member 14 may be provided with a non-uniform outer surface 40 such as ribbed, grooved or other keyed surface in order to increase the effectiveness of the seal created by the sleeve member 14 when secured within another casing section or borehole.

An elastomer 38 or other deformable material is bonded to the outer surface 40 of the sleeve 14; this may be as a single coating but is preferably a multiple of bands with gaps therebetween as shown in the Figure. The bands or coating may have a profile or profiles machined into them. In this embodiment, the elastomer bands 38 are spaced such that when the sleeve 14 is being morphed the bands 38 will contact the inside surface 82 of the open borehole 80 first. The sleeve member 14 will continue to expand outwards into the spaces between the bands 38, thereby causing a corrugated effect on the sleeve member 14. These corrugations provide a great advantage in that they increase the stiffness of the sleeve member 14 and increase its resistance to collapse forces.

A first end 42 of the sleeve 14 is attached to a stop 44 machined in the outer surface 36 of the body 12. Attachment is via pressure-tight connections to provide a seal. An O-ring seal (not shown) may also be provided between the inner surface 46 of the sleeve 14 and the outer surface 36 of the body 12 to act as a secondary seal or backup to the seal provided by the welded connection at the stop 44. Attachment could also be by means of a mechanical clamp.

A second stop 48 is arranged at a second end 50 of the sleeve 14. The second stop 48 may be clamped to the body 12 so that the sleeve 14 can be slid onto the body 12 over the second end during assembly. A seal 52 is provided at the outer surface 36 of the body 12 forward of the stop 48 so that the seal 52 is between the sleeve 14 and the body 12. This provides a sliding seal so that the end of the sleeve 14 is permitted to move towards the first end, relative to the body 12. Thus when the sleeve member 14 is caused to move in the radially outward direction, this causes simultaneous movement of the sliding seal 52, which has the advantage in that the thickness of the sleeve 14 is not further thinned by the radially outwards expansion.

Stop 44 together with the inner surface 46 of the sleeve 14 and the outer surface 36 of the body 12, define a chamber 16. In FIG. 1, the chamber 16 has a near negligible volume as the sleeve 14 and body 12 are close together. However, following morphing the chamber 16 will have a volume within the void created between the body 12 and the sleeve 14. The port 32 is arranged to access the chamber 16 and permit fluid communication between the throughbore 30 and the chamber 16.

At the port 32 there is located a check valve 54. The check valve 54 is a one-way valve which only permits fluid to pass from the throughbore 30 into the chamber 16. The check valve 54 can be made to close when the pressure within the chamber 16 reaches a predetermined level, this being defined as the morphed pressure value. Thus, if the pressure in the sleeve 14 reaches the morphed pressure value and we are pumping at the morphed pressure value, a zero pressure differential will occur across the valve 54 when the sleeve 14 has morphed and contacted the inner well bore wall. This zero pressure differential may be used to close the valve 54. Closure can be effected by bleeding off the valve 54. Also arranged at the port 32 is a rupture disc 56. The rupture disc 56 is rated to a pressure below, but close to the morphed pressure value. In this way, the rupture disc 56 can be used to control when the setting of the sleeve 14 is to begin. The disc 56 can be operated by increasing pressure in the throughbore 30 towards the morphed pressure value, but will prevent fluid exiting the throughbore 30 into the chamber 16 until this pressure value occurs.

Figure 2:
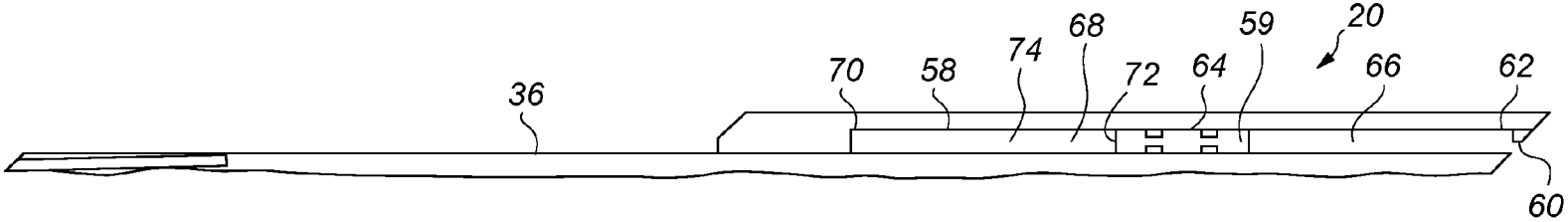
FIG. 2 is an expanded view of a portion of FIG. 1 to highlight the piston arrangement.

The pressure balancing system 20 is located at the first end 42 of the sleeve 14. Reference is now made to FIG. 2 of the drawings which illustrates the pressure balance system as shown in FIG. 1. A housing 58 is provided behind the stop 44. The housing 58 is sealed except for a conduit 60 arranged on the body from an end 62 of the housing 58, under the stop 44 and into the chamber 16. The conduit 60 provides a passageway for fluid from the chamber 16 to enter the housing 58. Arranged within the housing 58 is a piston 64, having a cross-sectional area matching that of the housing 58. Piston 64 is a plug which is initially held against the housing 58 by means of a shear pin 59. The shear pin 59 is rated to shear when the morphed pressure value is reached. Following release the piston 64 can move back and forth within the housing. The piston 64 separates the housing 58 into a chamber fluid portion 66 and a biasing portion 68. The biasing portion 68 may contain biasing means 74 in the form of a fluid and/or a spring arranged to act between a first end 70 of the housing and a base 72 of the piston 64.

In the embodiment shown in FIGS. 1 and 2, the pressure balancing system 20 is circumferentially arranged around the body 12 and the piston will have an annular cross-section. Alternatively, the housing may be a cylinder arranged as a pocket at the first end of the sleeve. The piston would then be a cylindrical plug. In a yet further embodiment there is a plurality of cylindrical housings arranged around the body. Such an arrangement may be easier to manufacture and assemble compared to the system 20 of FIG. 1.

If the biasing means 74 is set to act on the piston 64 with a pressure equal to the morphed pressure value, then for a fixed pressure and temperature, the fluid in the chamber 16 will occupy a fixed volume. Any change in pressure and/or temperature in the chamber will cause the volume to change. The biasing means 74 will act upon the piston and change the volume of fluid in the chamber 16 to correspond to the morphed pressure value and thus pressure can be maintained in the chamber 16.

Reference will now be made to FIG. 3 of the drawings which provides an illustration of the method for setting a sleeve within a well bore according to an embodiment of the present invention. Like parts to those in the earlier Figures have been given the same reference numerals to aid clarity.

In use, the assembly 10 is conveyed into the borehole by any suitable means, such as incorporating the assembly 10 into a casing or liner string 76 and running the string into the wellbore 78 until it reaches the location within the open borehole 80 at which operation of the assembly 10 is intended. This location is normally within the borehole at a position where the sleeve 14 is to be expanded in order to, for example, isolate the section of borehole 80*b* located above the sleeve 14 from that below 80*d* in order to provide an isolation barrier between the zones 80*b*,80*d*.

Additionally a further assembly 10*b* can be run on the same string 76 so that zonal isolation can be performed in a zone 80*b* in order that an injection, frac'ing or stimulation operation can be performed on the formation 80*b* located between the two sleeves 14, 14*a*. This is as illustrated in FIG. 3B.

Each sleeve 14,14*a* can be set by increasing the pump pressure in the throughbore 30 to a predetermined value which represents a pressure of fluid at the port 32 being the morphed pressure value. The morphed pressure value will be calculated from knowledge of the diameter of the body 12, the approximate diameter of the borehole 80 at the sleeve 14, the length of the sleeve 14 and the material and thickness of the sleeve 14. The morphed pressure value is the pressure sufficient to cause the sleeve 14 to move radially away from the body 12 by elastic expansion, contact the surface 82 of the borehole and morph to the surface 82 by plastic deformation.

When the morphed pressure value is applied at the port 32, the rupture disc 56 will have burst as it is set below the morphed pressure value. The check valve 54 is arranged to allow fluid from the throughbore 30 to enter the chamber 16. This fluid will increase pressure in the chamber 16 so as to cause the sleeve 14 to move radially away from the body 12 by elastic expansion, contact the surface 82 of the borehole and morph to the surface 82 by plastic deformation. When the morphing has been achieved, the check valve 54 will close and trap fluid at a pressure equal to the morphed pressure value within the chamber 16.

The sleeve 14 will have taken up a fixed shape under plastic deformation with an inner surface 46 matching the profile of the surface 82 of the borehole 80, and an outer surface also matching the profile of the surface 82 to provide a seal which effectively isolates the annulus 84 of the borehole 80 above the sleeve 14 from the annulus 86 below the sleeve 14. If two sleeves 14,14*a* are set together then zonal isolation can be achieved for the annulus 84 between the sleeves 14,14*a*. At the same time the sleeves 14,14*b* have effectively centered, secured and anchored the tubing string 76 to the borehole 80.

An alternative method of achieving morphing of the sleeve 14 is shown in FIG. 3B. This method uses a hydraulic fluid delivery tool 88. Once the string 76 reaches its intended location, tool 88 can be run into the string 76 from surface by means of a coiled tubing 90 or other suitable method. The tool 88 is provided with upper and lower seal means 92, which are operable to radially expand to seal against the inner surface 94 of the body 12 at a pair of spaced apart locations in order to isolate an internal portion of body 12 located between the seals 92; it should be noted that said isolated portion includes the fluid port 32. Tool 88 is also provided with an aperture 96 in fluid communication with the interior of the string 76.

To operate the tool 88, seal means 92 are actuated from the surface to isolate the portion of the tool body 12. Fluid, which is preferably hydraulic fluid, is then pumped under pressure, which is set to the morphed pressure value, through the coiled tubing such that the pressurised fluid flows through tool aperture 96 and then via port 32 into chamber 16 and acts in the same manner as described hereinbefore.

A detailed description of the operation of such a hydraulic fluid delivery tool 88 is described in GB2398312 in relation to the packer tool 112 shown in FIG. 27 with suitable modifications thereto, where the seal means 92 could be provided by suitably modified seal assemblies 214, 215 of GB2398312, the disclosure of which is incorporated herein by reference. The entire disclosure of GB2398312 is incorporated herein by reference.

Using either pumping method, the increase in pressure of fluid directly against the sleeve 14 causes the sleeve 14 to move radially outwardly and seal against a portion of the inner circumference of the borehole 80. The pressure within the chamber 16 continues to increase such that the sleeve 14 initially experiences elastic expansion followed by plastic deformation. The sleeve 14 expands radially outwardly beyond its yield point, undergoing plastic deformation until the sleeve 14 morphs against the surface 82 of the borehole 80 as shown in FIG. 3C. If desired, the pressurised fluid within the chamber 16 can be bled off following plastic deformation of the sleeve 14. Accordingly, the sleeve 14 has been plastically deformed and morphed by fluid pressure without any mechanical expansion means being required.

When the morphing has been achieved, the check valve 54 can be made to close and trap fluid at a pressure equal to the morphed pressure value within the chamber 16. At the same time the shear pin 59 will release the piston 64 in the housing 58. As long as the downhole temperature and pressure conditions remain static, the assembly 10 will operate and provide an isolation barrier in the well bore 78. However, we know this may not be the case and that the temperature, in particular, can vary significantly in the well bore 78.

An increase in temperature at the chamber 16 will cause the fluid in the chamber 16 to increase in pressure within the fixed volume. This increase in pressure will act upon the piston 64 in the pressure balancing system 20 causing the piston to be moved through the housing 58 against the biasing means 74. As the piston 64 moves, the volume occupied by the fluid in the chamber 16 will increase which will bring the pressure of the fluid in the chamber 16 down. As the biasing means 74 is set at the morphed pressure value, the piston 64 will move until the pressure differential across the piston is equal i.e. the pressure in the chamber 16 is at the morphed pressure value. In this way the pressure in the chamber is balanced at the morphed pressure value.

Similarly, a decrease in temperature at the chamber 16 will cause the fluid in the chamber 16 to decrease in pressure within the fixed volume. This decrease in pressure will cause the piston 64 to be moved through the housing 58 away from the biasing means 74 and towards the conduit 80, as the piston 64 moves to create a zero pressure differential across its faces. As the piston 64 moves, the volume occupied by the fluid in the chamber 16 will decrease which will bring the pressure of the fluid in the chamber 16 up. As the biasing means 74 is set at the morphed pressure value, the piston 64 will move until the pressure differential across the piston is equal i.e. the pressure in the chamber 16 is at the morphed pressure value. In this way the pressure in the chamber is balanced at the morphed pressure value. The pressure balancing means therefore increases and decreases the pressure of fluid in the chamber to maintain the pressure at the morphed pressure value.

The principle advantage of the present invention is that it provides an assembly for creating an isolation barrier in a well bore in which pressure within a morphed sleeve is balanced to maintain an effective barrier.

A further advantage of the present invention is that it provides a method for setting a sleeve in a well bore which uses a controlled pump pressure in the well bore as compared to maximum values used in the prior art.

A yet further advantage of the present invention is that it provides an assembly for creating an isolation barrier in a well bore in which pressure within a morphed sleeve is controlled so that the thickness of the sleeve can be reduced to improve the sealing contact during morphing.

It will be apparent to those skilled in the art that modifications may be made to the invention herein described without departing from the scope thereof. For example, while a morphed pressure value is described this may be a pressure range rather than a single value to compensate for variations in the pressure applied at the sleeve in extended well bores.

We claim:

1. An assembly, comprising:

a tubular body arranged to be run into a wellbore and secured within a larger diameter generally cylindrical structure;

a sleeve member positioned on the exterior of the tubular body and sealed thereto to create a chamber therebetween;

the tubular body including a port having a valve to permit the flow of fluid from a through bore of the tubular body into the chamber to increase pressure within the chamber to cause the sleeve to move outwardly and morph against an inner surface of the larger diameter structure;

wherein the valve traps pressure within the chamber to provide a morphed pressure value in the chamber; and the assembly further comprises a piston arranged within a housing, the housing being sealed except for a conduit for fluid coupling of the housing to the chamber, to maintain the morphed pressure value in the chamber by increasing and decreasing the trapped pressure.

2. An assembly according to claim 1 wherein the piston is arranged on the tubular body at an end of the sleeve.

3. An assembly according to claim 1 wherein the piston is annular and located around the tubular body.

4. An assembly according to claim 1 wherein there is a plurality of pistons arranged around the body.

5. An assembly according to claim 1 wherein the piston includes a shear pin release to operate the piston when the morphed pressure value is reached.

6. An assembly according to claim 1 wherein a first end of the piston acts on the fluid within the chamber and an opposing end includes a spring contained within the housing to move the piston against the fluid.

7. An assembly according to claim 1 wherein a first end of the piston acts on the fluid within the chamber and an opposing end acts on a biasing fluid held within the housing.

8. An assembly according to claim 1 wherein the valve is a one-way check valve set to close when the pressure in the chamber reaches the morphed pressure value.

9. An assembly according to claim 1 wherein the valve includes a ruptureable barrier device.

10. A method of setting a morphed sleeve in a well bore, comprising the steps:

(a) locating a sleeve member on the exterior of a tubular body and sealing the sleeve thereto to create a chamber therebetween;

(b) running the tubular body on a tubular member into a wellbore and positioning the sleeve member at a desired location within a larger diameter structure;

(c) pumping fluid through the tubular member and increasing the fluid pressure to provide fluid at a morphed pressure value at the sleeve member;

(d) opening a valve at a port in the tubular body to allow fluid from a through bore of the tubular body to enter the chamber;

(e) continuing to pump fluid at the morphed pressure value into the chamber causing the sleeve to move radially outwardly and morph against an inner surface of the larger diameter structure;

(f) closing the valve in the tubular body to trap pressure in the chamber; and (g) operating a piston arranged within a housing, the housing being sealed except for a conduit for fluid coupling of the housing to the chamber, to increase and decrease the trapped fluid pressure to maintain the trapped pressure at the morphed pressure value.

11. A method according to claim 10 wherein step (g) includes the step of exposing the fluid in the chamber to the piston and varying the volume of fluid in the chamber to increase and decrease the trapped pressure to maintain the trapped pressure at the morphed pressure value.

12. A method according to claim 10 wherein the method includes the step of rupturing a disc at the valve to allow fluid to enter the chamber when the pressure reaches a desired value.

13. A method according to claim 10 wherein the method includes the steps of running in a hydraulic fluid delivery tool, creating a temporary seal above and below the port and injecting fluid from the tool into the chamber via the port.

* * * * *